US006769190B2

(12) United States Patent
Carlisle

(10) Patent No.: US 6,769,190 B2
(45) Date of Patent: Aug. 3, 2004

(54) ADJUSTABLE VIEWING FRAME

(76) Inventor: David Tyrrell Carlisle, Stapleton Farmhouse, Stapleton, Martock, Somerset TA12 6AN (GB)

( * ) Notice: Subject to any disclaimer, the term of this patent is extended or adjusted under 35 U.S.C. 154(b) by 0 days.

(21) Appl. No.: 10/299,424

(22) Filed: Nov. 19, 2002

(65) Prior Publication Data

US 2003/0101607 A1 Jun. 5, 2003

(30) Foreign Application Priority Data

Nov. 19, 2001 (GB) ..... 0127679
Jul. 15, 2002 (GB) ..... 0216282

(51) Int. Cl.[7] ..... G03D 15/00
(52) U.S. Cl. ..... 33/427; 33/464; 33/1 K
(58) Field of Search ..... 33/1 K, 1 SB, 33/427, 452, 464, 481, 562; 355/72, 74

(56) References Cited

U.S. PATENT DOCUMENTS 985,086 A * 2/1911 Wilkes ..... 33/DIG. 9
1,183,977 A 5/1916 Hoefle
1,248,695 A * 12/1917 Morris ..... 33/427
2,087,102 A * 7/1937 Chandler ..... 33/DIG. 9
2,256,894 A * 9/1941 Chadkin ..... 355/74
2,315,066 A * 3/1943 Lund ..... 355/74
2,517,647 A * 8/1950 Field ..... 33/DIG. 9
2,560,937 A * 7/1951 Ens ..... 33/DIG. 9
2,626,467 A 1/1953 Abbott
2,646,626 A * 7/1953 Palin ..... 33/427
2,720,706 A * 10/1955 Laine ..... 33/427
3,224,100 A * 12/1965 Rose ..... 33/427
3,878,615 A 4/1975 Arrieta
4,268,967 A * 5/1981 Brana et al. ..... 33/452
4,558,522 A * 12/1985 Lance ..... 33/1 K
4,854,049 A 8/1989 Kuhtik ..... 33/464
5,045,878 A 9/1991 Taeger ..... 355/74
5,551,160 A 9/1996 Ferris et al. ..... 33/452

FOREIGN PATENT DOCUMENTS

DE 3530900 3/1987
FR 2 678 725 1/1993

* cited by examiner

*Primary Examiner*—G. Bradley Bennett
(74) *Attorney, Agent, or Firm*—Gifford, Krass, Groh, Sprinkle, Anderson & Citkowski, P.C.

(57) ABSTRACT

An adjustable viewing frame (27) for use by artists to help compose a view comprises two frame members (10,11) each having two frame links (21,22,23,24) at right angles to one another. The frame links (21,22,23,24) have a rib (30) along one edge over which two C-shape clips (20) engage to hold the two frame members (10,11) together where they overlap. The force exerted by the clips (30) is sufficient to hold the two frame members (10,11) together against disturbances so that the frame (27) thus formed can be held in one hand for viewing purposes, but allows adjustments to be made easily by hand to change the size and/or relative proportions of the frame (27). A scale (40) marked on the frame member (10) allows specific relative proportions to be achieved with certainty and precision.

14 Claims, 5 Drawing Sheets

ADJUSTABLE VIEWING FRAME

BACKGROUND OF THE INVENTION

This invention relates to an adjustable viewing frame of a type used by artists and others to help to compose a view. One known such frame comprises no more than a piece of card with a square or rectangle cut out of it. Another known such frame comprises a piece of glass or transparent plastic with a square or rectangle marked on it. Such frames are light and easy to make, but they are not readily adjustable to form apertures of different sizes or proportions.

Adjustable frames are known for cropping pictures or photographs. These are usually made from two L-shape pieces of cardboard, plastic, metal or the like which are either separate or mounted to be carried on a board. It is not easy to hold up two separate pieces in just one hand for framing a field of view, which would be useful for an artist, especially in the absence of any means for holding their two pieces in a fixed position relative to one another. The picture-cropping frame cannot be used for this purpose, however because of its weight, which inhibits the user from carrying them, and, especially from holding them up in one hand while drawing or painting with the other.

The prior art also includes the frame described in U.S. Pat. No. 1,183,977 which comprises four rectilinear arms with elongate central slots in them. The arms are held together in pairs by respective nuts and bolts, and the two structures thus formed are held together but threaded pins passing through the slots onto which are screwed thumb nuts to clamp a so-called spider into the slots. This device has the advantage that it can be folded into a compact space, but the disadvantage that it is complex, involving many parts, and requires that the two thumb nuts be slackened to allow adjustment and then re-tightened when the adjustment is made. It is also difficult to set this up with the corners exactly square.

OBJECTS OF THE INVENTION

One aspect of the present invention is to provide an adjustable viewing frame which is an improvement over the prior art.

Another aspect of the invention is to provide a viewing frame, which is quick and simple to adjust, light in weight and economical to produce.

Still another aspect of the invention is to provide a viewing frame which can be easily adjusted to a predetermined ratio of side sizes to form a viewing aperture of selected shape.

A further aspect of the invention is a viewing frame which can be held in one hand for use or easily mounted on an easel or other support for use by an artist.

SUMMARY OF THE INVENTION

The present invention provides an adjustable viewing frame comprising at least two frame members having arms forming substantially rectilinear frame limbs, in which the frame members are held together by a frictional force which is sufficient to retain the frame members in a selected adjusted position but which can be overcome to effect adjustment. The frictional force can be applied by retainer members. Such retainer members may be resiliently biased into engagement with the said frame members.

In one embodiment the retainer members are generally C-shape and engage respective frame members from opposite sides thereof.

Each limb of a frame member preferably has a respective shoulder extending at least along a part of the length thereof. Such shoulder is engageable by the retainer members in order to hold the frame members together.

The said shoulders of the frame limbs may comprise the side wall of an upstanding ridge or rib extending longitudinally at least part of the way along the frame limb. If the frame limbs are laminar or sheet like elements the longitudinal ridge or ribs may be located substantially along one edge thereof. Alternatively, the said shoulder may be formed by an elongate, longitudinally extending, slot, groove or channel in each frame limb. In such case the retainer members may have heads engaged in the said slot, groove or channel of respective frame limbs whereby to hold them together to form the said frame.

The frictional engagement of the two frame members is preferably achieved by resilient deformation of the retainer members. Such resilient deformation may be flexure, extension or compression.

The present invention also comprehends an adjustable viewing frame comprising at least two frame members having arms forming substantially rectilinear frame limbs, in which the frame members are held together by magnetic attraction sufficient to generate a frictional force which retains the frame members in a selected adjusted position, but which can be overcome to effect adjustment.

For this purpose at least part of at least one of the said frame members may be magnetised and at least part of the other frame member may be made of ferromagnetic material. The magnetic attraction may be effected, of course, by the introduction of appropriate magnetic materials into otherwise non-magnetic members or elements such as plastics. Alternatively, plastics or other non-magnetic materials having magnetic or magnetised particles imbedded therein may be employed.

The adjustable frame of the invention may further include mounting means for mounting the frame to an easel, stand, tripod, table or other support. Such mounting means may also be used as a hand grip by which the frame may be held for viewing.

According to another aspect the present invention provides an adjustable viewing frame comprising two generally L-shape frame members, each having two substantially orthogonal rectilinear frame limbs, and means for retaining the two members together in a selected relative position to form a relatively rectangular frame, in which the frame limbs of at least one frame member bear a scale including indicia representing different dimensional ratios to which the viewing frame may be adjusted.

The invention will be more easily understood from the following detailed descriptions thereof with reference to the drawings.

DESCRIPTION OF THE PREFERRED EMBODIMENT

Figure 1:
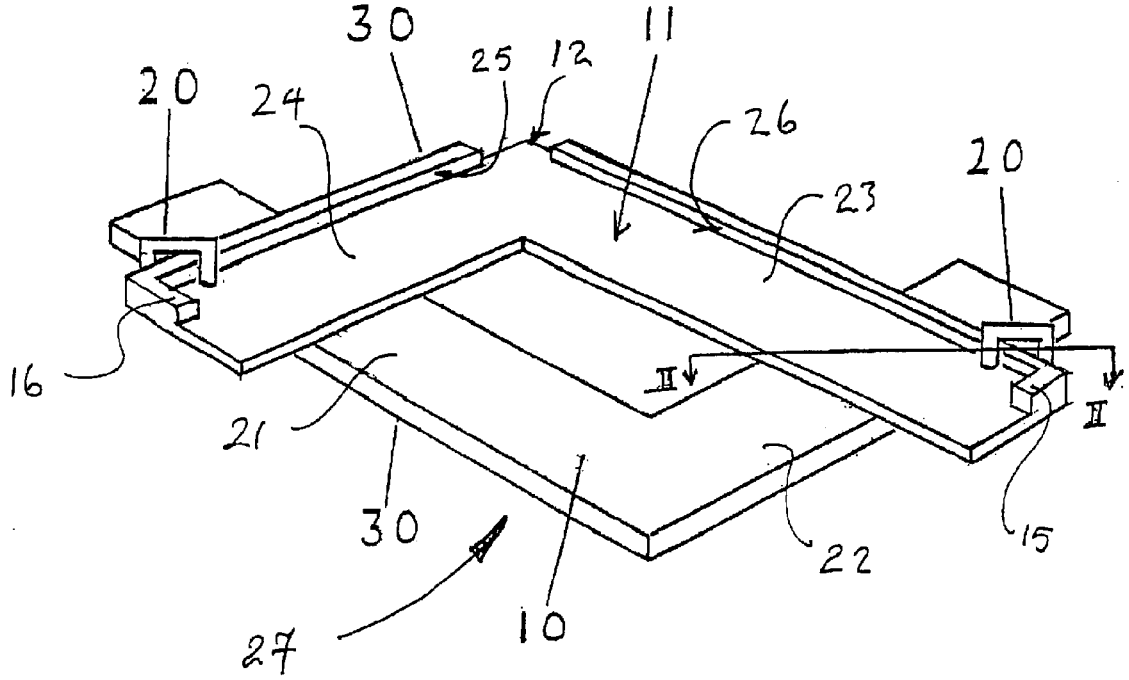
FIG. 1 is a perspective view of a first embodiment of the invention.

Referring first to FIG. 1 of the drawings, this shows a frame 27 comprising two L-shape frame members 10 and 11, typically made of plastic, metal, cardboard, composites, wood or other suitable material; which may be opaque, semi-transparent or transparent. The two L-shape frame members 10 and 11 each have two frame limbs 21,22 and 23,24, with one frame limb 21,23 of each frame member being longer than the other (although in other embodiments these arms may be of equal length as will be described below). In use of the illustrated embodiment the two L-shape frame members 10,11 will for preference be so positioned that the long frame limbs 21,23 of the two frame members 10,11 are opposite each other, in the position shown in FIG. 1.

The two L-shape frame members 10 and 11 are held together by two retainers 20 in the form of clips, one positioned at the outside edge of each of the two corners where the frame limb of one L-shape frame member crosses the frame limb of the other L-shaped frame member: as shown in FIG. 1.

Figure 2:
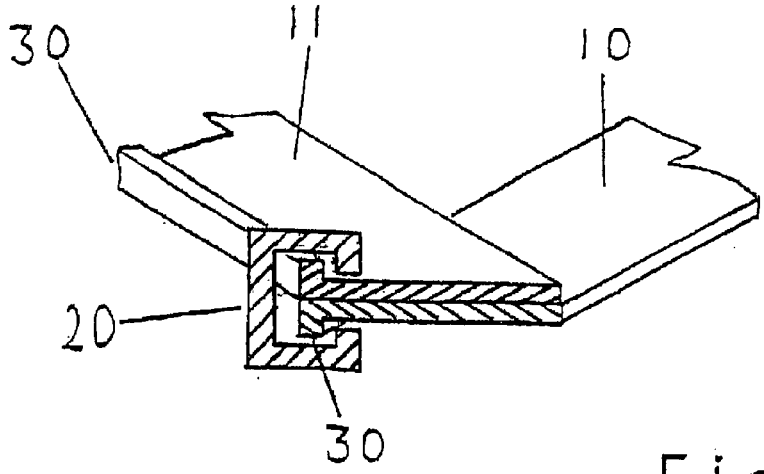
FIG. 2 is a partially sectioned detail view of the embodiment of FIG. 1 taken on the line II—II of FIG. 1.

The two L-shape frame members 10 and 11 are each formed with a ridge 30 along one edge of each frame limb 21,22 and 23,24. The L-shape frame members are so made that the face which contacts the other L-shape frame member is flat, with the ridge 30 being on its other side. The clips 20 pass over the two ridges 30. A cross-section of this arrangement is shown in FIG. 2. The ridges 30 terminate a short distance from the elbow 12 of the L-shape frame member 10 or 11, and at the free end 13,14 of each frame limb the ridges 30 each have a transverse stop end or shoulder 15, 16. This facilitates introduction of the clips 20 at the elbow 12 upon assembly and ensures that upon enlargement of the frame 27 the clips 20 cannot pass beyond the free ends 13, 14 to allow the two L-shape frame members 10, 11 to become separated.

The clips 20 are so formed that, when the user of the frame 27 wishes to adjust it, the two L-shape frame members 10,11 will slide easily over each other; but at the same time, the clips 20 exert enough force to hold the two L-shape frame members in the same position relative to each other when released. The clips 20 achieve this by being made of resilient material and being shaped so that they are stressed when engaged in position. The clips 20 may be made of plastics; metal, composites, or other suitable materials, or of a combination of materials. A separate resilient element may be used to provide the resilient stress in other embodiments (not shown).

Figure 3:
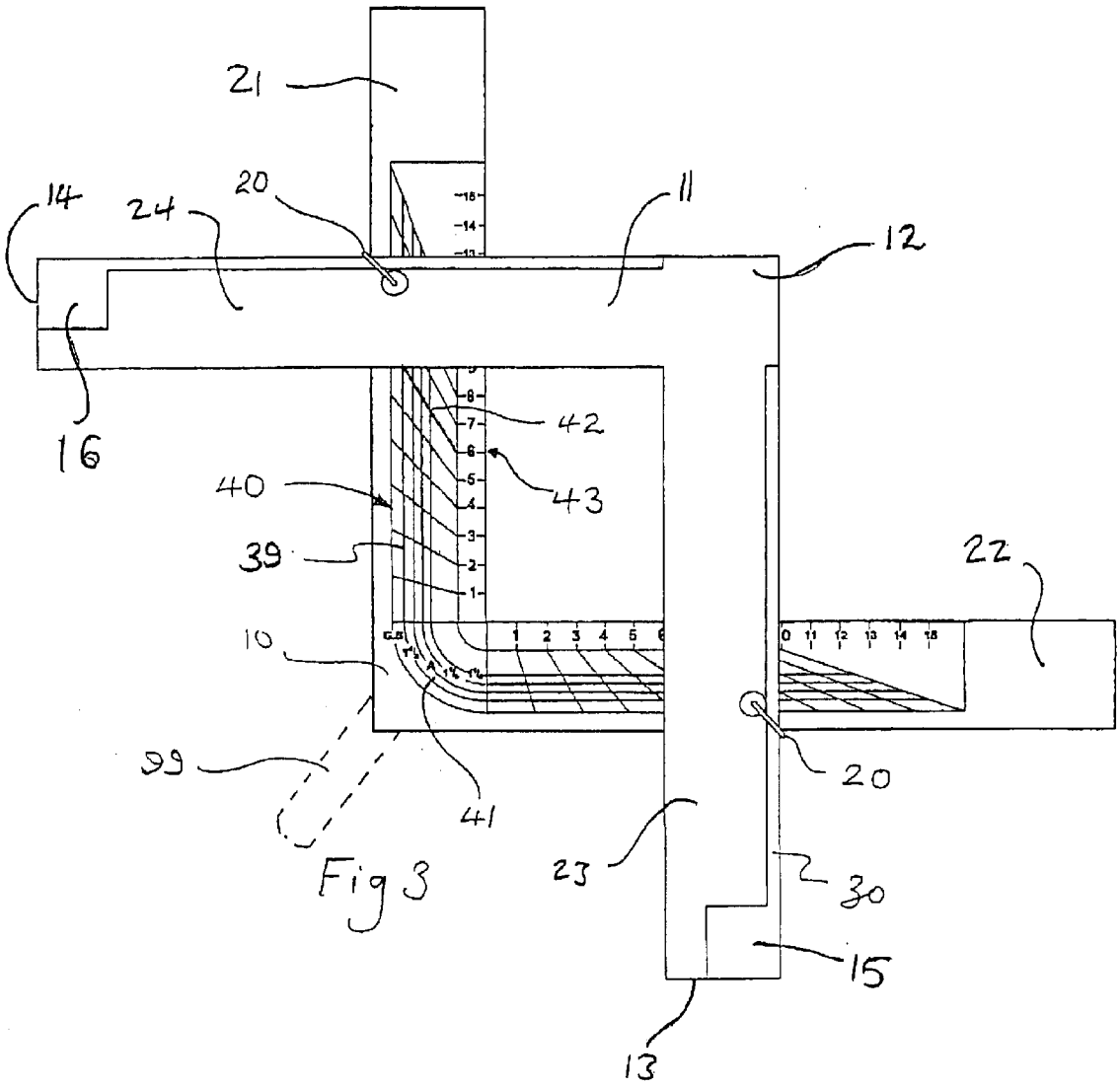
FIG. 3 is a plan view of the embodiment of FIG. 1 illustrating the use of the proportioning scale.

In the embodiment of the invention, shown in FIG. 3 the two frame members 10,11 have limbs 2,22 and 23,24 of equal length. One L-shape frame member 10 carries a scale 40, marked upon it by engraving, printing or other means, which enables the user to set the opening defined between the frame members to form a rectangle (or square) in which one side bears a specified ratio to the other, whatever the size of the opening.

The scale includes ratios commonly used, in the paper industry or in art, such as for example 1:√2, 1:1.5, etc.

Figure 4:
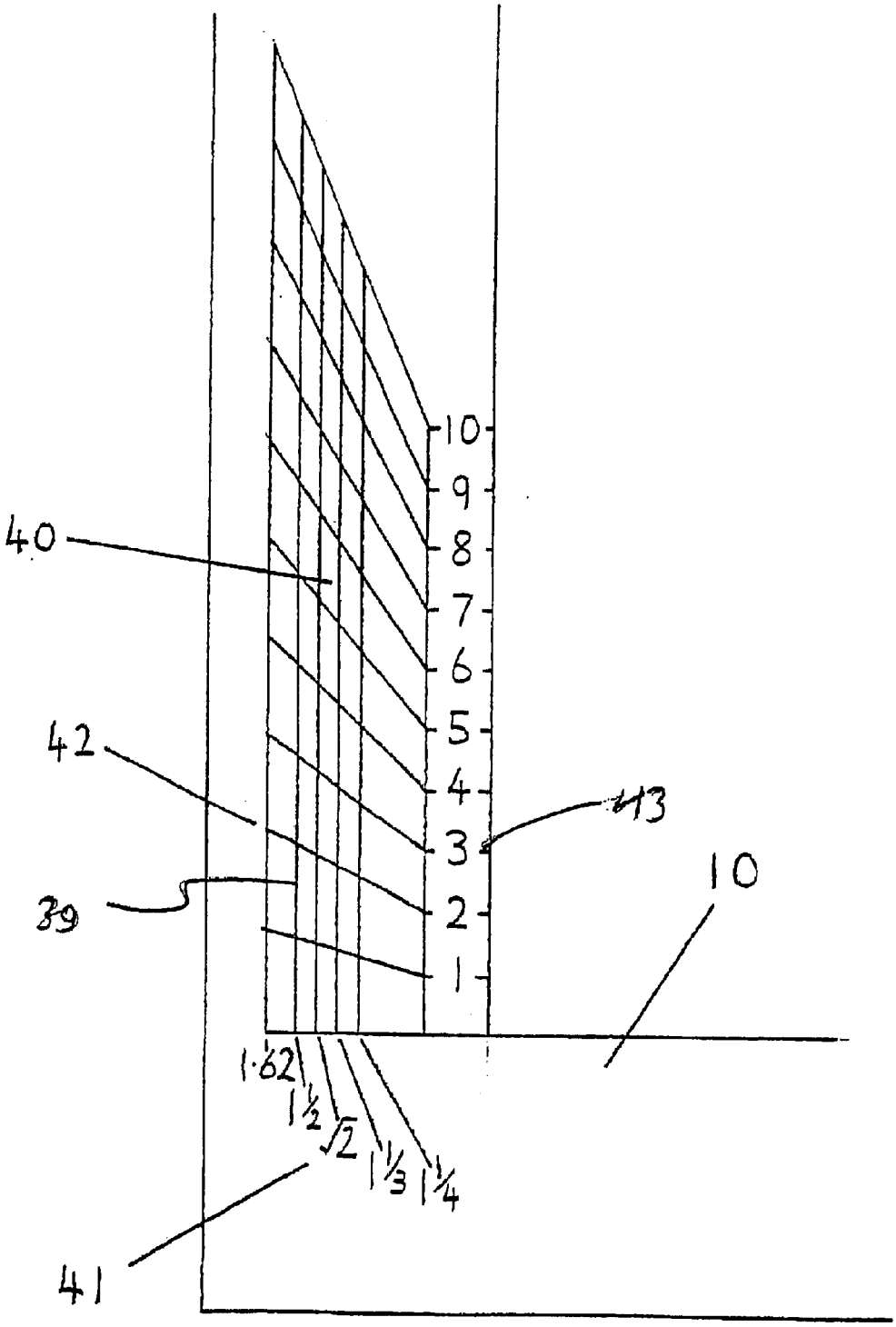
FIG. 4 is an enlarged view of a part of the embodiment of FIG. 3 illustrating the proportioning scale on a larger scale.

This scale 40 is also shown in FIG. 4, and comprises a plurality of longitudinal graduations lines 39 spaced at distances determined by the set proportions as represented by ratio legends 41. A plurality of intersection lines 42, by reference to which the proportions of the frame may be set, extend at an angle from regular gradation positions marked with a scale 43 representing specific dimensions, for example centimeters.

The scale is used by placing the edge of frame limb 24 of the L-shaped frame member 11 over a desired figure on the scale 43, and positioning the other arm of L-shaped frame member 11 over the appropriate intersection line 42 on the other arm of the scale, as shown in FIG. 3. By selecting the appropriate intersection point between a longitudinal graduation line 39 representing the ratio and the inclined line 42 associated with the gradation number 43 corresponding to that against which the other frame limb 23 is set, the user may construct a desired rectangle in either landscape or portrait format. As can be seen in FIG. 3 the frame limb 23 is set at 6 marked on the frame limb 22 and the frame limb 24 is set to the corresponding size at a ratio of 1:1.5 (represented on the scale by 1½) by selecting the intersection of the inclined line extending from 6 and the longitudinal graduation line 39 marked 1½ on the frame limb 21.

Figure 5:
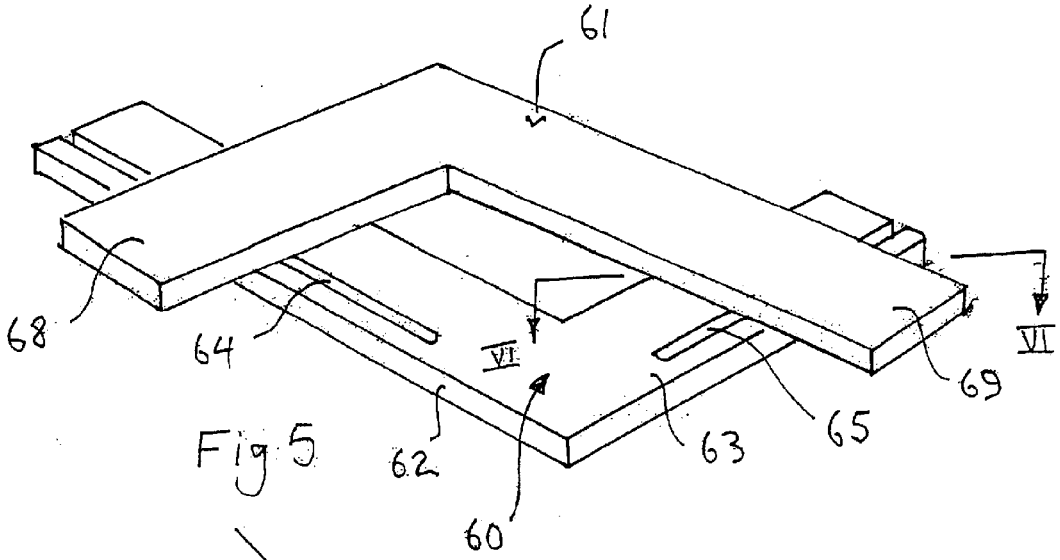
FIG. 5 is a perspective view of an alternative embodiment illustrating slot and link interconnection of the frame members.

In a further embodiment of the invention, shown in FIGS. 5 and 6, two L-shape frame members 60, 61 are held together by different means, as follows. Each of the rectilinear limbs 62, 63 of the L-shape frame member 60 has a respective elongate slot 64, 65 which, as can be seen in FIG. 6, has a T-shape cross section with an enlarged head portion 66 and a narrow neck portion 67.

Figure 6:
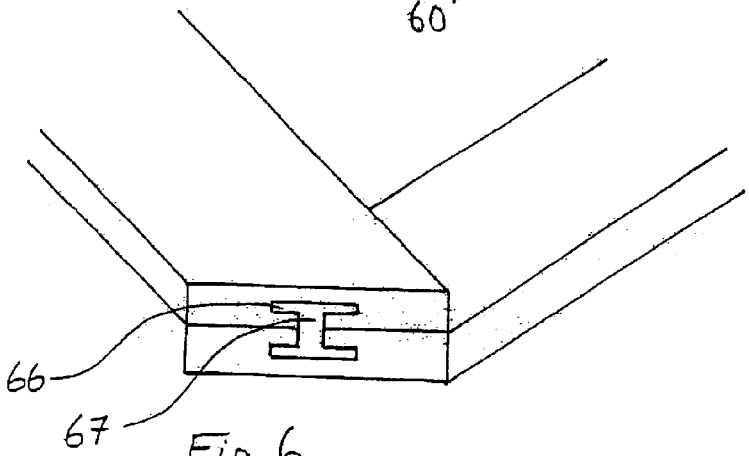
FIG. 6 is a sectional view through the embodiment of FIG. 5 taken on the line VI—VI of FIG. 5.

The frame limbs 68, 69 of the L-shape frame member 61 have corresponding identically shaped slots as can be seen in FIG. 6.

Figure 6A:
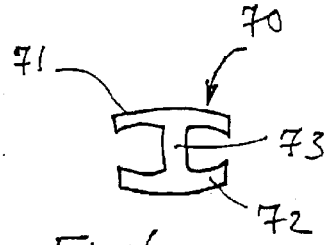
FIG. 6*a* is a sectional view of a link for retaining the two frame members in the embodiment of FIGS. 5 and 6.

A retainer member in the form of a linking stud 70 having two mushroom heads 71, 72 on opposite ends of a central stem 73 fits into the intersection between two grooves or slots 64, 65 at the point where two frame limbs 62, 68 or 63, 69 overlap. As can be seen in FIG. 6*a* the mushroom heads 71, 72 are slightly domed so that, when fitted into the head section 66 of a slot, with the stem 73 residing in a neck portion 67, the head is slightly flexed to give a frictional interengagement between the linking stud 70 and the slots to achieve the same frictional contact as described in relation to the C-shape clips of the earlier embodiments. The embodiment of FIGS. 5 and 5 has the advantage of avoiding the need for external clips.

Figure 7:
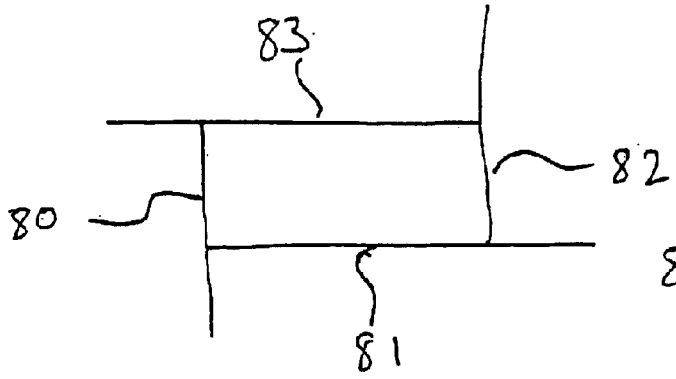
FIG. 7 is a schematic view of an alternative embodiment of the invention utilising four identical frame members.
Figure 8:
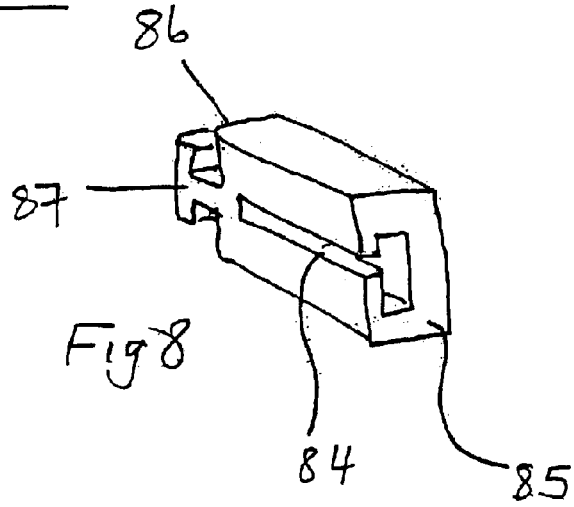
FIG. 8 is a schematic view of a frame member suitable for use in the embodiment of FIG. 7.

The embodiment of FIGS. 7 and 8 is different from the earlier embodiments in that it comprises four identical elongate frame limbs 80, 81, 82, 83 each, as illustrated in FIG. 8, having an elongate slot 84 of T-section extending from one end 85 to a point close to the other end 86 at which there is a T-shape projection 87 which, in assembling the frame, is engaged in a slot of an adjacent member. The four frame elements can be pushed towards one another or pulled apart to reduce or enlarge the size of the frame opening.

Figure 9:
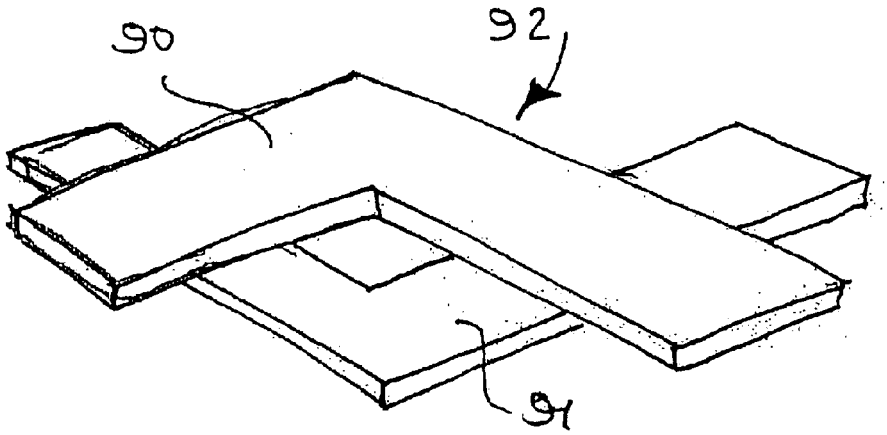
FIG. 9 is a perspective view of a further embodiment.

FIG. 9 illustrates a final embodiment of the invention in which a frame 92 comprising two identical L-shape frame elements 90, 91 are made from magnetised or magnetisable material, or at least material such as a geomagnetic material, which is influenced by magnetic attraction so that they are retained in the selected position simply by magnetic attraction holding the two facing surfaces with sufficient force to generate a frictional engagement which is enough to ensure that the frame 92 remains in the selected adjustment when in use, but not so great that it cannot be overcome by manual exertion when it is desired to vary the adjustment.

In any embodiment of the invention, one of the two L-shaped frame members may be equipped with a mounting device such as a handle, an arm or bracket 99, which enables the frame to be either directly or indirectly mounted on an easel, stand, tripod, table, or other support. An example is shown in broken outline in FIG. 3.

What is claimed is:

1. An adjustable viewing frame comprising:

at least two frame members, said at least two frame members having arms forming substantially rectilinear frame limbs, means for applying a frictional force between said at least two frame members whereby said frame members are held together by a frictional force, said frictional force being sufficient to retain said frame members in a selected adjusted positions, said frictional force being sufficient to be overcome to effect adjustment by hands said means for applying a frictional force comprise retainer members acting to retain the frame limbs in relation to one another, wherein said retainer members are generally C-shape and engage respective frame members from opposite sides thereof, each said limb of a frame member has a respective outwardly protruding shoulder extending at least part of the way along the length thereof and being engageable by the respective C-shape retainer members whereby to hold the retainer members on the frame members.

2. The adjustable viewing frame of claim 1, wherein said retainer members are resiliently biased into engagement with the said frame members.

3. The adjustable viewing frame in claim 1, wherein said shoulders of the said frame limbs comprise the upstanding side wall of a ridge or rib extending longitudinally at least part of the way along said frame limbs.

4. The adjustable viewing frame of claim 3, wherein the said frame limbs are laminar elements and the longitudinal ridge or rib is located substantially along one edge thereof.

5. The adjustable viewing frame of claim 1, wherein said shoulder is formed by an elongate longitudinally extending, slot, groove or channel in each frame limb.

6. The adjustable viewing frame of claim 5, wherein said retainer members have heads engaged in the said slot, groove or channel of respective frame limbs whereby to link them together to form the said frame.

7. The adjustable viewing frame of claim 1, wherein said frictional engagement of the two frame members is achieved by resilient deformation of the retainer members.

8. The adjustable viewing frame of claim 1, wherein said frictional force is applied by magnetic means.

9. The adjustable viewing frame of claim 8, wherein at least part of at least one of the said frame members is magnetised and at least part of said other frame member is made of ferromagnetic material.

10. The adjustable viewing frame of claim 1, wherein at least one said frame limb of each frame member is marked with a scale bearing indicia representing different dimensional ratios to which the viewing frame can be adjusted.

11. The adjustable frame of claim 1, and comprising means for mounting said frame to one of an easel, stand, tripod and table.

12. The adjustable viewing frame of claim 1, wherein said retainer members are slidable along the limbs of the frame members.

13. The adjustable viewing frame of claim 1, wherein said shoulders extend transversely across the free ends of the arms of the frame limbs whereby to provide a stop to prevent passage of the retainer members beyond the arms.

14. The adjustable viewing frame of claim 1, wherein the frame members are joined at an elbow and the shoulders terminate before the elbow to facilitate introduction of said frame limbs into said retainer members.

* * * * *